US008973799B2

(12) United States Patent
Ruiz, III et al.

(10) Patent No.: US 8,973,799 B2
(45) Date of Patent: Mar. 10, 2015

(54) HANGER BRACKET FOR TRANSFORMING AND CONCEALING EXISTING GUN HOLSTERS

(71) Applicants: Leopoldo Ruiz, III, Laredo, TX (US); Jose M Herrera, Jr., Laredo, TX (US)

(72) Inventors: Leopoldo Ruiz, III, Laredo, TX (US); Jose M Herrera, Jr., Laredo, TX (US)

( * ) Notice: Subject to any disclaimer, the term of this patent is extended or adjusted under 35 U.S.C. 154(b) by 189 days.

(21) Appl. No.: 13/862,322

(22) Filed: Apr. 12, 2013

(65) Prior Publication Data

US 2014/0305983 A1 Oct. 16, 2014

(51) Int. Cl.

*F41C 33/00* (2006.01)
*F41C 33/02* (2006.01)
*F41C 33/04* (2006.01)

(52) U.S. Cl.

CPC ..... *F41C 33/048* (2013.01)
USPC ..... 224/587; 224/192; 224/193; 224/198

(58) Field of Classification Search

CPC ..... F41C 33/048; F41C 1/04; F41C 33/00; F41C 3/023; A41F 9/002
USPC ..... 224/587, 192, 193, 198, 911, 912
See application file for complete search history.

(56) References Cited

U.S. PATENT DOCUMENTS

| | | | | | |
|---|---|---|---|---|---|
| 2,609,979 | A * | 9/1952 | Spann | 224/615 |
| 3,583,612 | A * | 6/1971 | Theodore | 224/243 |
| 4,165,826 | A * | 8/1979 | Chica | 224/191 |
| 4,235,356 | A * | 11/1980 | Atchisson | 224/192 |
| 4,253,592 | A * | 3/1981 | Anderson | 224/198 |
| 4,544,089 | A * | 10/1985 | Tabler | 224/192 |
| 5,465,429 | A * | 11/1995 | Rogers et al. | 2/300 |
| 5,570,827 | A * | 11/1996 | Wiesner | 224/587 |
| 5,909,834 | A * | 6/1999 | Parrott, III | 224/587 |
| 6,089,432 | A * | 7/2000 | Gage et al. | 224/587 |
| 6,092,703 | A * | 7/2000 | Johnson | 224/198 |
| 8,371,487 | B1 * | 2/2013 | Plappert | 224/193 |
| 2004/0026471 | A1 * | 2/2004 | Gallagher | 224/193 |
| 2006/0219743 | A1 * | 10/2006 | Gallagher | 224/192 |
| 2010/0181353 | A1 * | 7/2010 | Craighead | 224/193 |
| 2010/0270349 | A1 * | 10/2010 | Craighead | 224/587 |

* cited by examiner

*Primary Examiner* — Justin Larson
*Assistant Examiner* — Lester L Vanterpool

(57) ABSTRACT

A hanger bracket is attached to any existing gun holster with the existing holster belt clip removed from the holster and attached to a top of the bracket. The bottom of the bracket is attached to the holster at the previous attachment location of the belt clip to the holster. The belt clip is attached over the outside of a belt of a user and the bracket, holster and gun are inserted down inside the pants of the user for complete concealment. The shape, spacing, orientation, and number of holster attachment openings through the bracket make it adaptable to a variety of holsters and adjustable to various vertical heights of the holster attachment to the bracket.

12 Claims, 11 Drawing Sheets

HANGER BRACKET FOR TRANSFORMING AND CONCEALING EXISTING GUN HOLSTERS

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to a gun holster accessory and in particular to a gun holster conversion concealment hanger bracket device attached to any existing gun holster to convert the existing holster into a concealed holster with the existing holster belt clip removed from the holster and attached to a top of the bracket and the bottom of the bracket attached to the holster at the previous attachment location of the belt clip to the holster so that the gun and gun holster hang down from the hanger inside the pants of the user concealed from view below the top of the pants with the belt clip extending out over the outside of the belt of the wearer and clipped to the belt to support the hanger bracket and the gun and holster in the concealed position.

2. Description of Related Art Including Information Disclosed Under 37 CFR 1.97 and 1.98

Most of the holsters fitting inside the pants leave the handle of the gun sticking above the waistband and belt and required covering up with a shirt or coat to conceal the handle. While there were a few patents which provided for a holster inside the pants which provide most of the gun fitting inside the pants, there was no prior art which provided a device for converting existing outside holsters into concealed holsters maintaining the gun hidden behind the pants.

U.S. Pat. No. 4,165,826, issued Aug. 28, 1979 to Chica, indicates a holster and a belt for carrying a handgun where the holster is releasably secured to the belt for locating the handgun within trousers to maintain the handgun sufficiently hidden until exposed for use. The holster has a pocket member for receiving the handgun and a flexible portion which connects the holster to the belt. This flexible portion is of a length which locates the entire handgun where it is carried by the pocket portion of the holster below the belt such that it will be normally hidden from view. To expose the handgun for operation, the operator can simply press the holster, upwardly exposing at least a grip of the handgun for grasping by the user.

U.S. Pat. No. 5,570,827, issued Nov. 5, 1996 to Wiesner, shows an improved pistol holster including a holster body and a pager or a pager-unit attached to the holster body. Bulging of the holster body is minimized by the provision of wings extending forwardly and rearwardly to enhance the stiffness of the holster body.

U.S. Pat. No. 7,204,395, issued Apr. 17, 2007 to Gallagher, provides a method and apparatus for flexing a concealed holster to secure the contents of the holster in the holster. An elongate substantially rigid elastically flexible sling is secured to a side of the holster such that the elongate member and side of the holster can be partially separated so the wearer's shirts can be inserted therebetween to conceal the holster. The lower end of the sling can be flexed outwardly away from the side of the holster such that a portion of the outer side adjacent the lower end is, when the sling is flexed outwardly to insert the wearer's shirt, flexed inwardly to compress a pistol in the storage compartment.

U.S. Pat. No. 5,881,938, issued Mar. 16, 1999 to Wakefield, provides a unibody, combination grip plate and appendage fastening means constructed in such a manner so as to be received at the frame of a handgun. The unibody grip plate and appendage fastening means is affixed to the handle of a handgun; the appendage fastening means portion, which is camouflaged and concealable behind a user's wearing apparel, lifts and moves independently away from the grip plate portion permitting Total Weapon Concealment (TWC) of a handgun inside the waistband (IWB) between the user's torso and trouser, or other wearing apparel) completely below the belt line (BBL). A handgun that is equipped with the principal object can be placed IWB in a comfortable and secure fashion. The appendage fastening means facilitates TWC of a handgun BBL, yet the principal object allows a person who is covertly carrying a handgun fingertip access and immediate use.

U.S. Pat. No. 3,379,349, issued Apr. 23, 1968 to Hier, claims a belt-attached holster for supporting a pistol in a partially concealed position inside the waist bond of the user. The belt engaging section of the holster has a rigid, hook-shaped metal strip which engages the lower edge of the belt to provide a connection between the hook-shaped metal strip and the pistol-receiving pouch.

U.S. Pat. No. 6,402,001, issued Jun. 11, 2002 to Madarang, is for an improved concealed holster comprising a holster bracket worn at the abdomen and having a pair of laterally-spaced spacer flanges joined by an arcuate panel generally conforming to the curve of the body. A pistol seating clip protrudes inward from the arcuate panel for seating a pistol thereon within the confines of the flanges, panel and the user's body. The holster is intended to be worn under the trousers at the abdomen and the pistol is easily dislodged by pressing up on its barrel with one hand, and then quick-drawn with the other hand. The improved holster does not compromise between accessibility and full-concealment, permitting instant accessibility to facilitate a quick-draw. Both holster and pistol can be worn comfortably and securely over a prolonged period of time. Moreover, the device can easily and economically be made using a variety of economical manufacturing processes (molding, metal stamping, etc.) using a variety of alternative economical materials (plastic, metal, leather, etc.).

U.S. Pat. No. 4,022,361, issued May 10, 1977 to Devlin, describes a holster for carrying a concealed weapon. A holster case is secured to a sling. The upper end of the sling carries fastening means which can be detachably secured to the inner side of the belt of the wearer with the holster and gun concealed within the trousers and beneath the shirt of the wearer. In the preferred embodiment a fabric fastener of the cooperating loop and hook fastener material is utilized to secure the sling to the wearer's belt.

U.S. Pat. No. 4,471,465, issued May 3, 1988 to Johnson, discloses a special handgun holster that is capable of concealing a handgun on a person who is wearing only walking shorts and no shirt. Concealing the handgun is accomplished by enveloping the grip end of the handgun inside a pouch that appears to be a large truckers wallet protruding slightly from the pants pocket or walking shorts pocket and camouflaging the muzzle end of the handgun in the lower part of the front pants pocket or walking shorts pocket by adding a block of material to break up the outline of the handgun. In addition a metal bar is placed through the pouch to keep the handgun securely in the pants or walking shorts pocket and to position the pouch around the handgun grip.

U.S. Pat. No. 8,225,976, issued Jul. 24, 2012 to Meunier, puts forth a belt assembly and a container therefore. The belt assembly includes an inner belt, a supporting belt and at least one container. The inner belt is adapted to be installed around a wearer's waist. The supporting belt is adapted to be cohesively affixed to the inner belt. The container is adapted to be affixed to the supporting belt and cohesively affixed to the inner belt. The container is adapted to carry equipment in a receiving compartment, and includes a fixating structure for affixing the receiving compartment to the supporting belt and cohesively affixing to the inner belt.

U.S. Pat. No. 6,213,364, issued Apr. 10, 2001 to Wakefield, claims a rigid appendage fastening means that may be adapted to mount an apparatus that is commonly possessed and carried by law enforcement officers, military personnel and civilians, who are licensed to do so, diurnally. The appendage fastening means is specifically designed to be mounted to those items that the user intends to keep hidden from the view of a casual observer. The device's primary design characteristic is that of a loosely formed sigmate. The principal object is camouflaged to suit the user's apparel, thereby enhancing the device's covert characteristics and applications. The device provides the user with a secure environment to place an item inside the waistband (IWB) and below the belt line (BBL). Objects of appropriate size and utility, which have the principal object mounted to them, can be secreted upon the user's person IWB. Said object remains IWB, BBL with Total Concealment (TC), easily accessible, safe, secure, and immediately available for use. The invention is ergonomically designed so as not to restrict a user's freedom of movement, or range of motion.

What is needed is a gun holster conversion concealment hanger bracket attachable to any existing holster for converting existing outside holsters into concealed holsters hanging the gun and holster in a concealed position inside the pants with the entire gun and holster fitting inside the pants below the waistline.

BRIEF SUMMARY OF THE INVENTION

An object of the present invention is to provide a gun holster conversion concealment hanger bracket device attached to any existing gun holster to convert the existing holster into a concealed holster with the existing holster belt clip removed from the holster and attached to a top of the bracket and the bottom of an opposite face of the bracket attached to the holster at the previous attachment location of the belt clip to the holster so that the gun and gun holster hang down from the hanger inside the pants of the user concealed from view below the top of the pants with the belt clip extending out over the outside of the belt of the wearer and clipped to the belt so that the hanger bracket suspends the gun and gun holster below the top of the pants in the concealed position.

Another object of the present invention is to provide a gun holster conversion hanger bracket with a number of variously positioned and variously shaped openings through the bracket to mate with attachment openings of any of a variety of gun holsters and belt clips so that the bracket can convert any of a wide variety of existing gun holsters into concealed gun holsters.

An added object of the present invention is to provide an adaptable gun holster hanger bracket having a plurality of openings extending along the length of a bottom portion of the hanger bracket so that the gun holster can be attached to the bracket at various vertical positions along the length of the hanger bracket to insure that the gun and gun holster hang below the top of the pants concealed inside the pants.

One more object of the present invention is to provide a hanger bracket which allows the gun holster to hang down inside the pants of a user with the normally outside face of the holster facing in toward the body of the user so that the user can easily reach inside the top of the pants to draw the gun from the holster.

In brief, a gun holster concealment conversion hanger bracket is attached to any existing gun holster with the existing holster belt clip removed from the holster and attached to a top of the bracket. The bottom of the bracket is attached to the holster at the previous attachment location of the belt clip to the holster. The belt clip is attached over the outside of a belt of a user and the bracket, holster and gun are inserted down inside the pants of the user. The holster is turned around to face inward and hangs down from the bracket well below the waistline of the pants. A gun in the holster is completely concealed inside the pants below the top of the pants.

An advantage of the present invention is that it converts any of an existing gun holsters into a concealed gun holster suspending the gun and gun holster below the top of the pants in a completely concealed position.

Another advantage of the present invention is that it provides an adaptable gun holster conversion hanger bracket which can convert any of a wide variety of existing gun holsters into concealed gun holsters.

An added advantage of the present invention is that it provides an adjustable gun holster hanger bracket so that the gun holster can be attached to the bracket at various vertical positions along the length of the hanger bracket to insure that the gun and gun holster hang below the top of the pants concealed inside the pants.

One more advantage of the present invention is that it provides an easy to use concealed gun holster hanging from the hanger bracket inside the pants of a user with the normally outside face of the holster facing in toward the body of the user so that the user can easily reach inside the top of the pants to draw the gun from the holster.

BRIEF DESCRIPTION OF THE SEVERAL VIEWS OF THE DRAWINGS

These and other details of the present invention will be described in connection with the accompanying drawings, which are furnished only by way of illustration and not in limitation of the invention, and in which drawings.

DETAILED DESCRIPTION OF THE INVENTION

Figure 2:
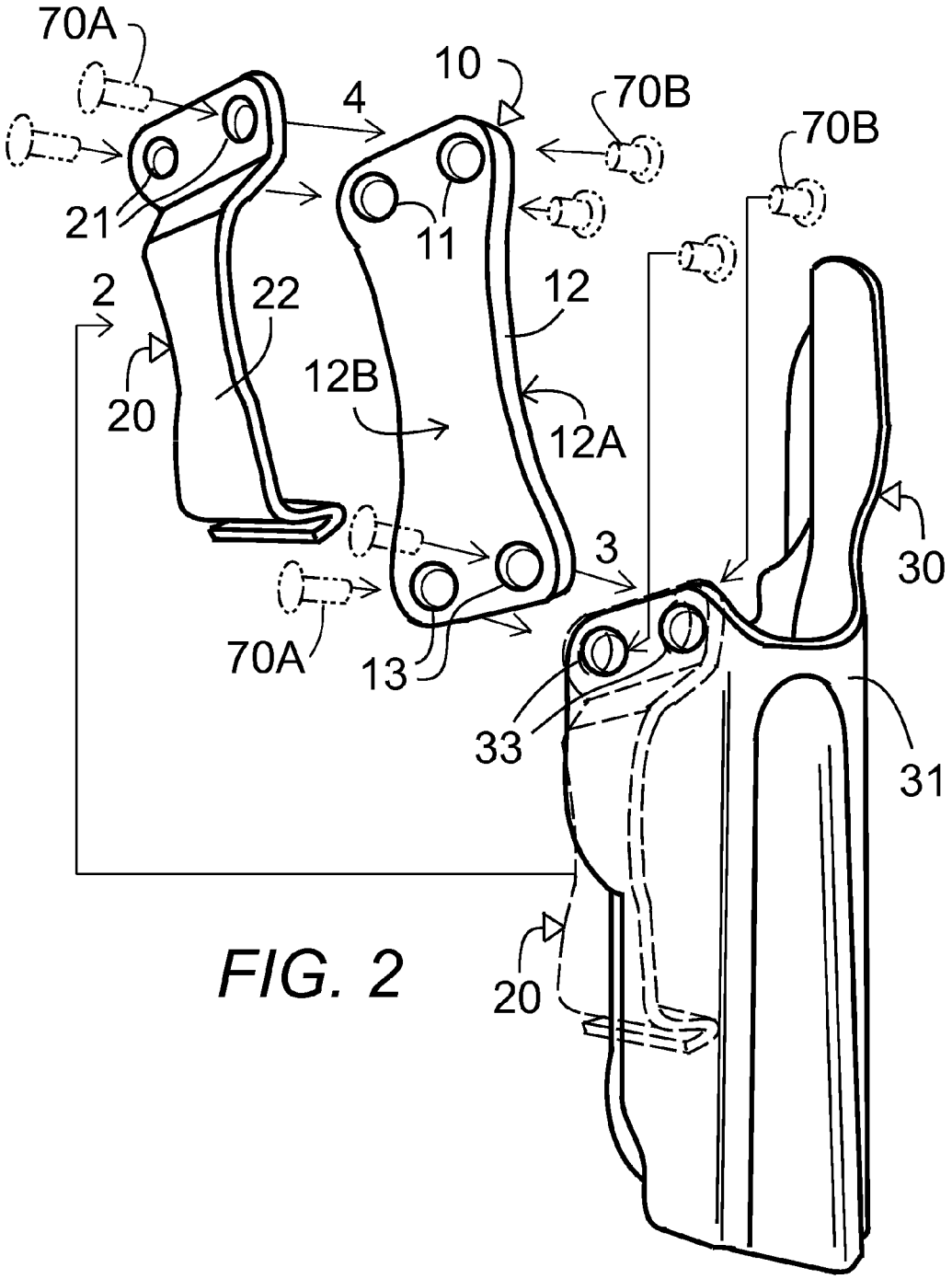
FIG. 2 is an exploded perspective view showing the hanger bracket of the present invention aligned for assembly between the gun holster and the belt clip removed from the gun holster.
Figure 3:
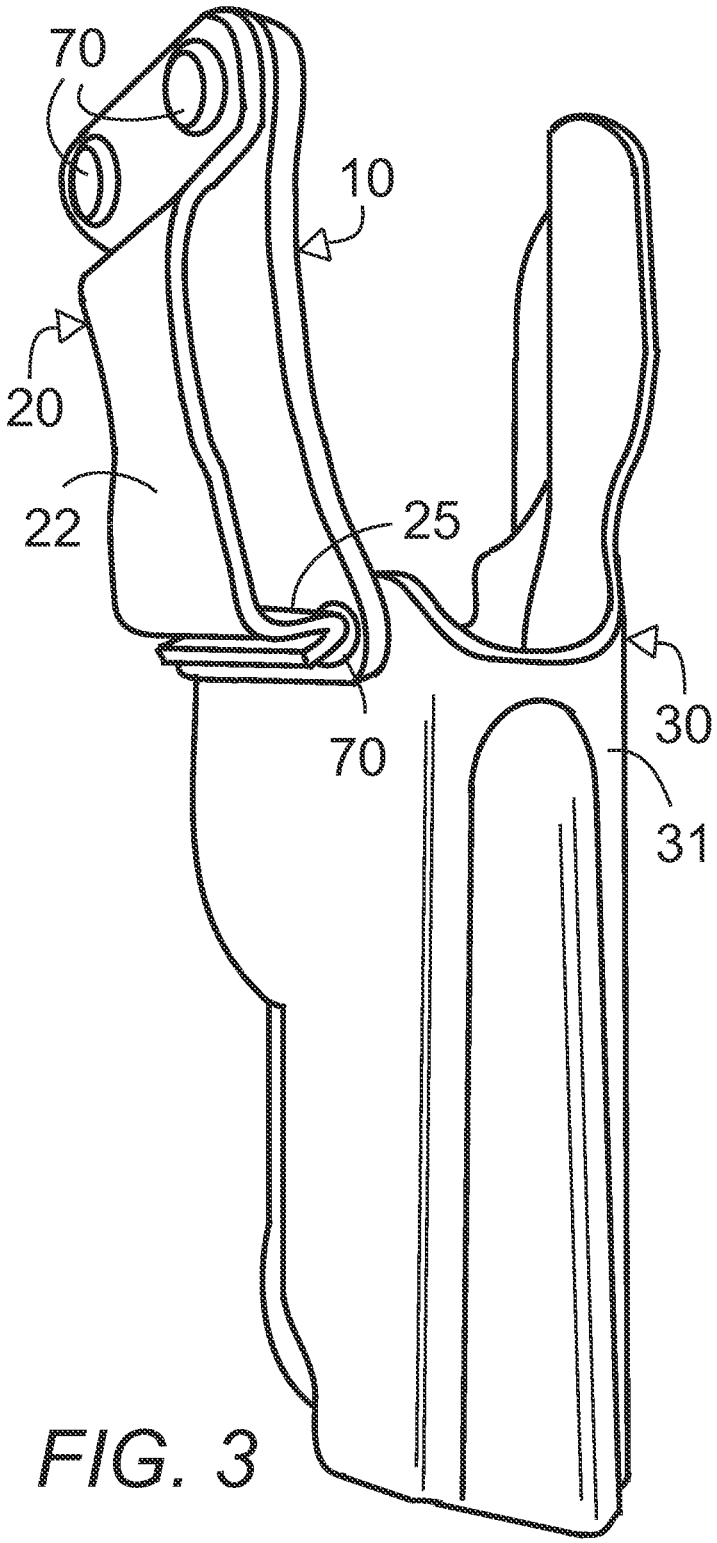
FIG. 3 is a perspective view of the hanger bracket of the present invention with a bottom of one bracket face attached to the gun holster and the removed belt clip attached to a top of an opposite bracket face to form the assembled transformed concealed gun holster with hanger bracket.
Figure 4:
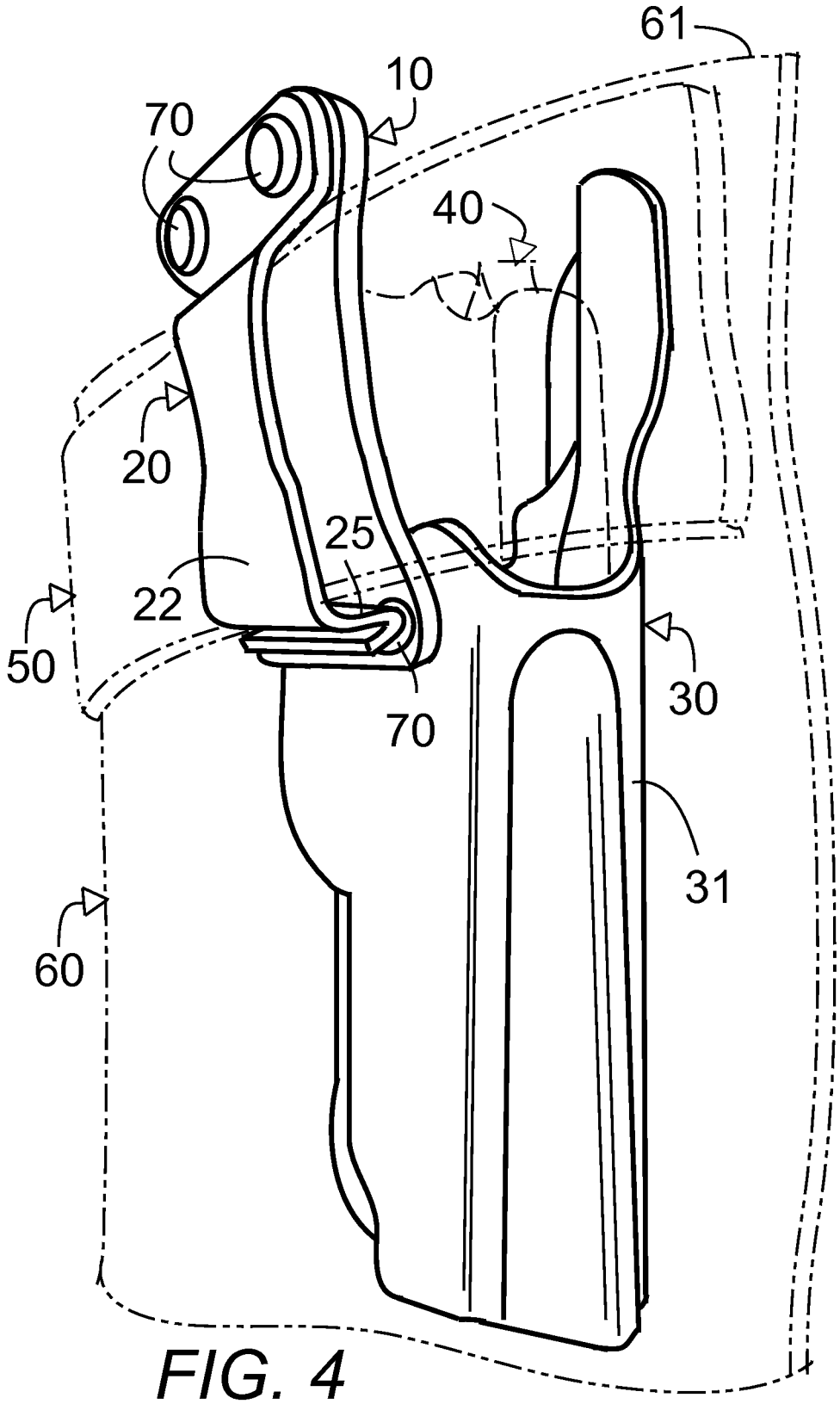
FIG. 4 is a perspective view showing the assembled transformed concealed gun holster with hanger bracket with a dashed partial view of the pants and belt of a user in relation to the position of the concealed gun and gun holster.
Figure 5:
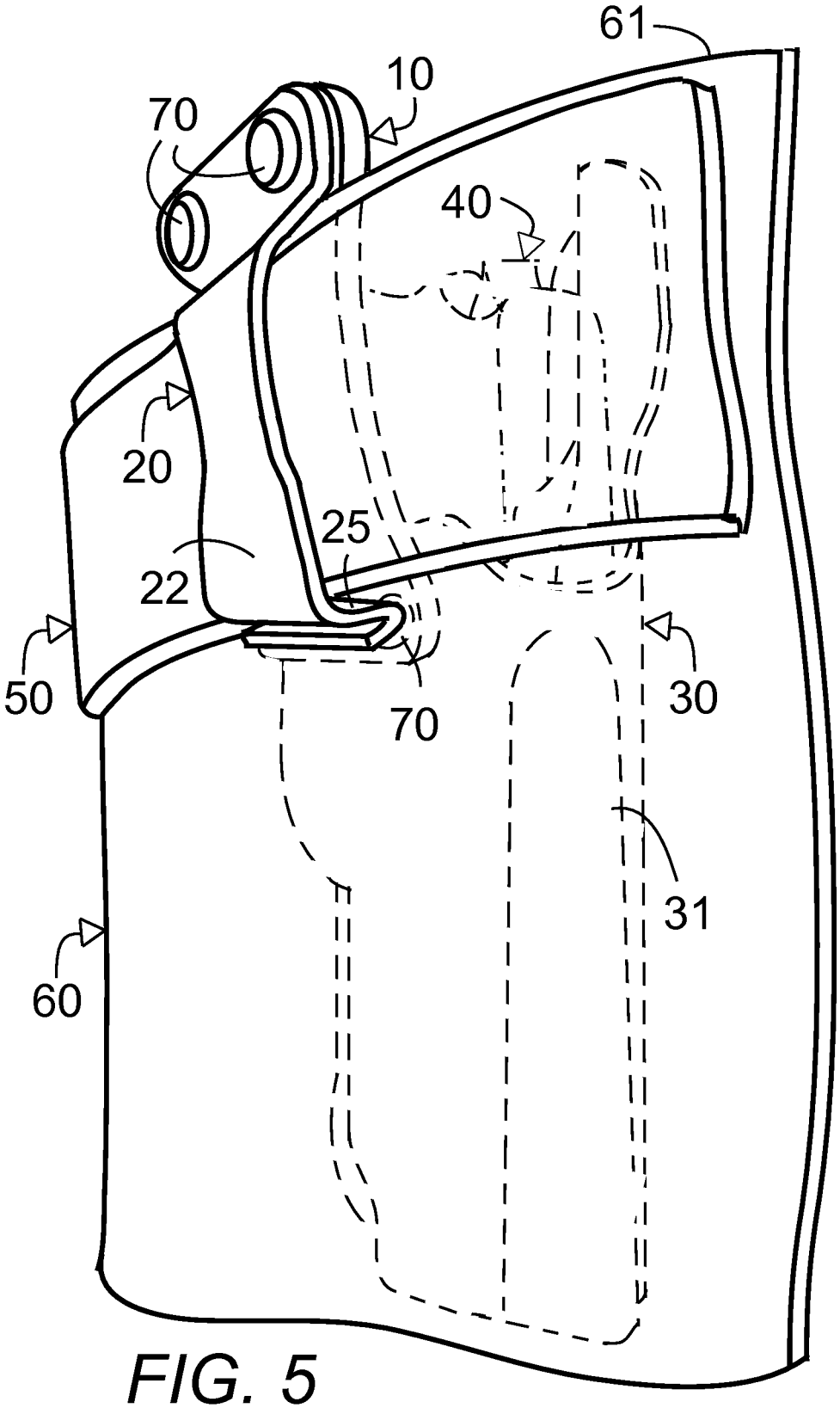
FIG. 5 is a partial perspective view showing the assembled transformed concealed gun holster with most of the hanger bracket and all of the gun and gun holster shown in dashed lines concealed behind the pants and belt of a user shown in partial perspective view and the belt clip outside of the belt clipped to the belt shown in solid lines.

In FIGS. 1-11, a gun holster concealment hanger bracket 10 device attaches to a gun holster 30 to convert the gun holster into a concealed gun holster, as shown in FIGS. 4 and 5 with the gun 40 and gun holster 30 concealed below the waistline 61 of the pants 60 of a user.

Figure 1:
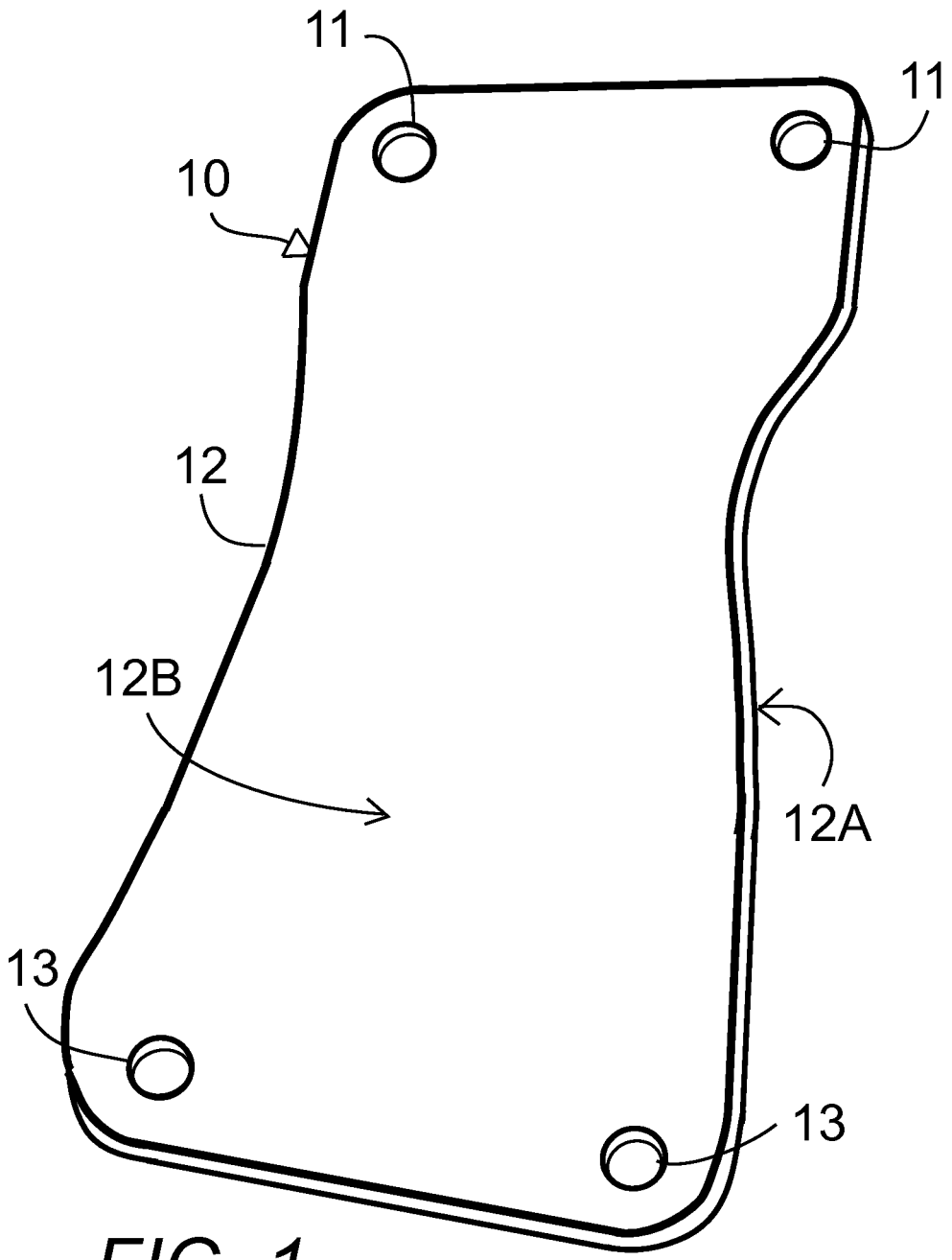
FIG. 1 is a perspective view of the gun holster concealment hanger bracket of the present invention.

In FIGS. 1 and 2, the hanger bracket 10 comprises an elongated planar bracket 12 having a first face 12A and a second face 12B and having means, such as fasteners 70, which may have two interconnecting components 70A and 70B, through a pair of spaced lower bracket openings 13, for attaching a bottom portion of a first face of the hanger bracket 10 to a gun holster 30 at an attachment location 33 of a holster belt clip 20 with the holster belt clip 20 removed from the gun holster 30, and means, such as fasteners 70 through a pair of spaced top bracket openings 11, for attaching the removed holster belt clip 20 to a top portion of a second face of the hanger bracket 10, as shown in FIG. 3.

In FIGS. 4 and 5, the hanger bracket 10, gun holster 30 and gun 40 are inserted inside the pants 60 of a user so that the gun 40 and gun holster 30 hang down from the hanger bracket 10 inside the pants of the user in a concealed position. All of the gun 40 and gun holster 30 are concealed entirely from view below the top 61 of the pants 60, which may be the waistband. The belt clip 20 extends from the top of the hanger bracket 10 out over the outside of a belt 50 of the user, the belt clip 20 clipped to the belt 50 of the user to support the hanger bracket 10 and the gun 40 and the gun holster 30 in the concealed position inside the pants 60 of the user, thereby forming a gun holster concealment hanger bracket 10 to attach to any existing gun holster 30, having an attached belt clip 20 from the holster attached to the hanger bracket 10, to convert the existing holster into a concealed holster, as shown in FIG. 5.

In FIGS. 1 and 2, the means for attaching the bottom portion of the bracket 10 to any existing holster 30 comprises a fastener 70, which may have two interconnecting connecting components 70A and 70B, as shown in FIGS. 2-5, through at least one bottom bracket opening 13 through a bottom portion of the bracket 10, the at least one bottom bracket opening 13 mating with at least one holster opening 33 on the gun holster 30 normally used in mounting the belt clip 20 to the gun holster 30, the at least one mating holster opening also receiving the fastener 70 therethrough. In FIG. 2, with the belt clip 20 removed, the bottom of the bracket is secured to the gun holster 30 by means for fastening planar elements (such as fastener 70) inserted through the at least one bottom bracket opening 13 and the at least one holster opening 33. In FIG. 2, the means for attaching the top portion of the bracket 10 to the removed belt clip 20 comprises at least one top bracket opening 11 through the bracket mating with at least one existing belt clip opening 21 for mounting the belt clip 20 to the top of the bracket 10. The top of the bracket 10 is secured to the removed belt clip 21 by means for fastening planar elements (such as fastener 70) inserted through the at least one top bracket opening 11 and the at least one belt clip opening 33.

In FIGS. 1 and 2, the at least one bottom bracket opening comprises a pair of spaced bottom bracket openings 13 through the bracket 10 mating with an existing pair of spaced holster openings 33 and at least one top bracket opening comprises a pair of spaced top bracket openings 11 through the bracket 10 mating with an existing pair of spaced belt clip openings 21 and the means for fastening planar elements 70 is inserted through each of the mating pairs of openings.

In FIG. 1, the size, and especially the length, of the bracket 10 and spacing of the single paired openings 11 and 13 can be custom configured to work with a specific type of gun holster 30, as shown in FIGS. 2-5.

In FIGS. 6-11, the shape, spacing, orientation, and number of openings through the bracket make each of the brackets adjustable for different types of holsters and different depths of hanging the holsters below the top of the pants.

Figure 6:
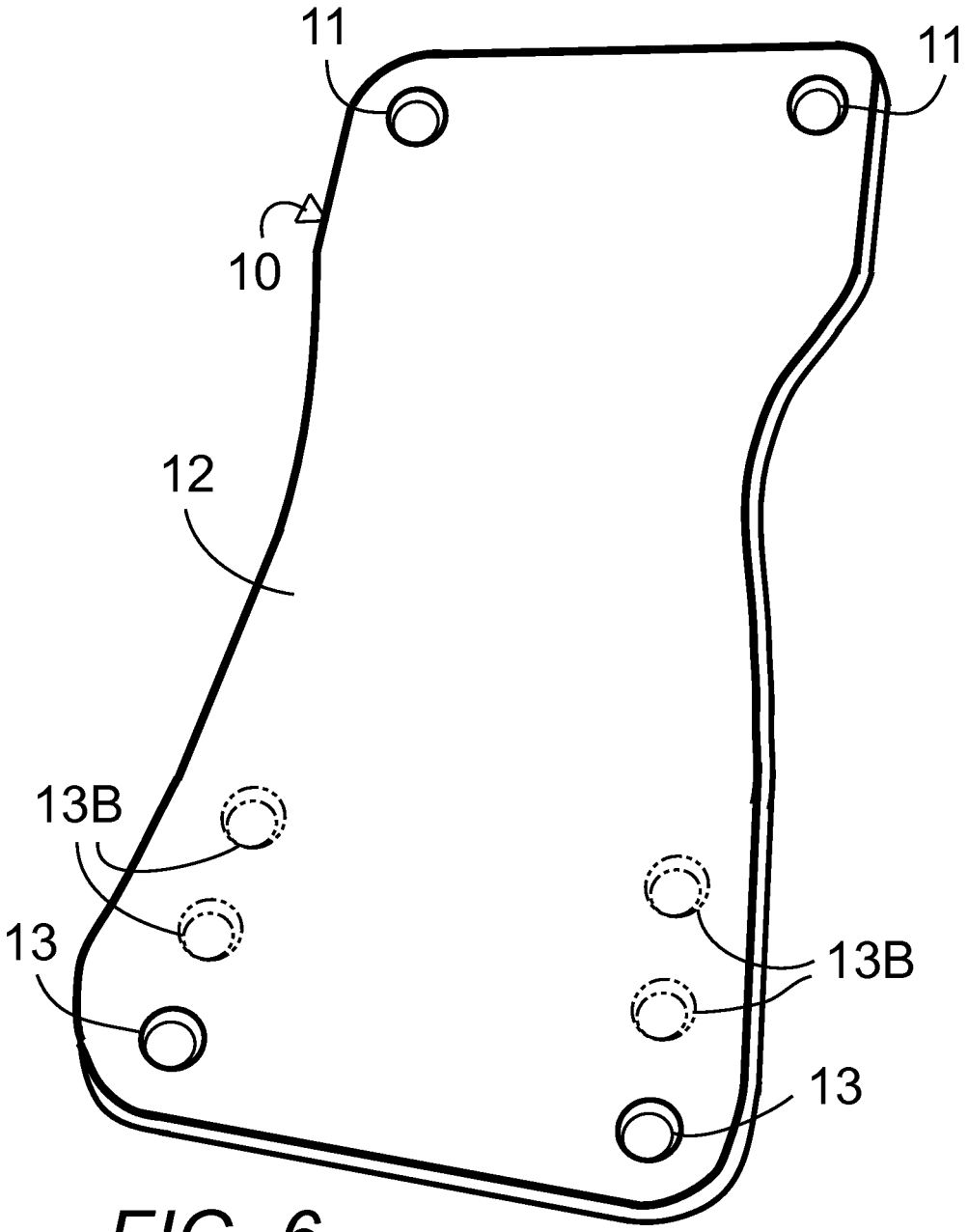
FIG. 6 is a perspective view of an alternate multiple vertical opening adjustable embodiment of the gun holster concealment hanger bracket of the present invention having a plurality of vertically stacked spaced pairs of bottom bracket openings through the bracket to mate with a pair of spaced holster openings so that the gun holster is adjustable in vertical position along the height of the bracket.

In FIG. 6, the at least one bottom bracket opening comprises a plurality of spaced vertically aligned pairs of bottom bracket openings 13 and 13B through the bracket mating with a pair of spaced holster openings so that the gun holster is adjustable in vertical position along the height of the bracket 10 to insure full concealment of the gun and holster.

Figure 7:
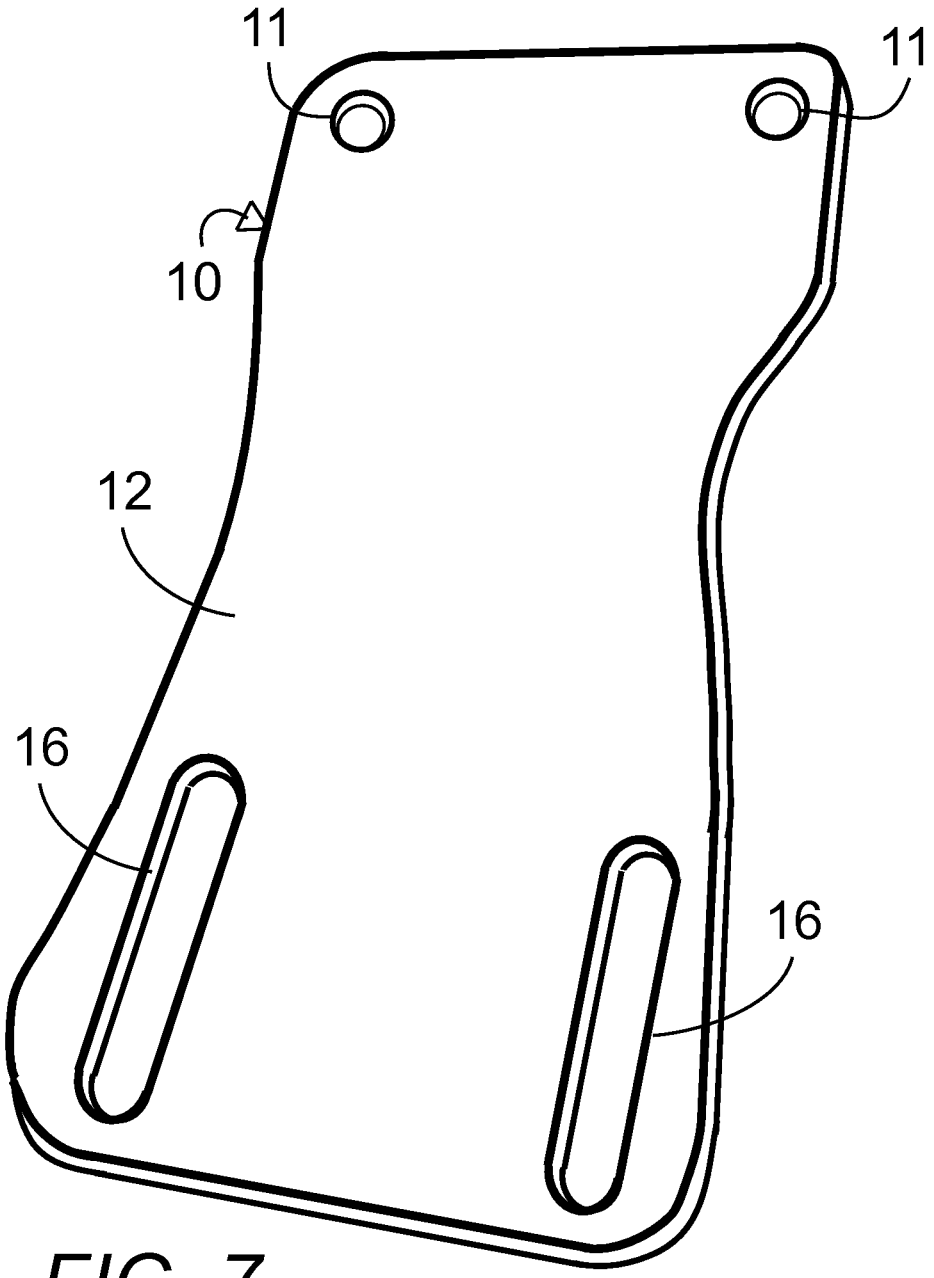
FIG. 7 is a perspective view of an alternate vertically slotted adjustable embodiment of the gun holster concealment hanger bracket of the present invention having a pair of spaced vertically aligned slots through the bracket to mate with a pair of spaced holster openings so that the gun holster is adjustable in vertical position along the height of the bracket.

In FIG. 7, the at least one bottom bracket opening comprises a pair of spaced vertically aligned slots 16 through the bracket mating with a pair of spaced holster openings so that the gun holster is adjustable in vertical position along the height of the bracket 10 to insure full concealment of the gun and holster.

Figure 8:
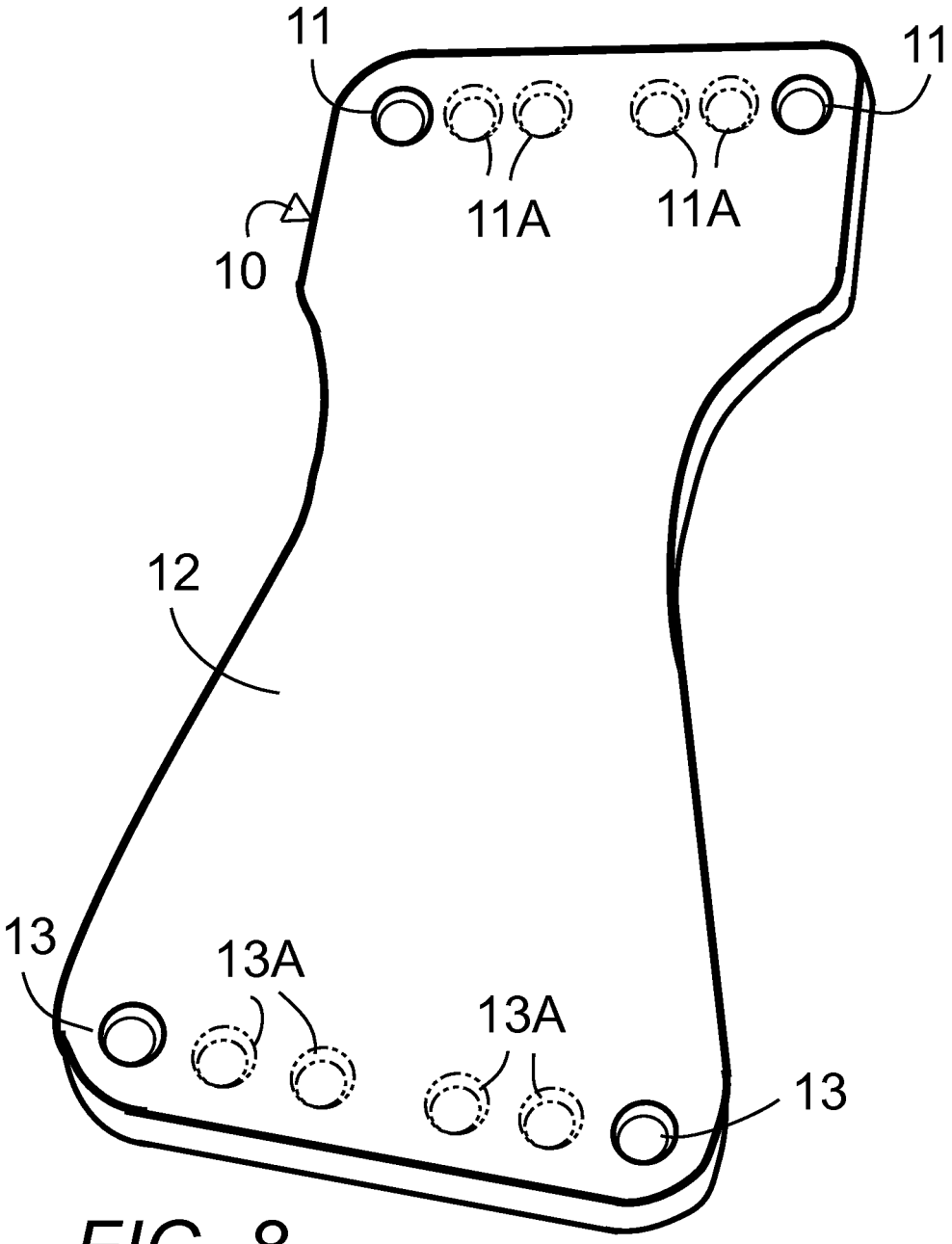
FIG. 8 is a perspective view of an alternate multiple horizontal opening adaptable embodiment of the gun holster concealment hanger bracket of the present invention having a plurality of spaced horizontally aligned bottom bracket openings through the bracket to mate with any existing pair of spaced holster openings on any of a variety of different holsters.

In FIG. 8, the at least one bottom bracket opening comprises a plurality of spaced horizontally aligned bottom bracket openings 13 and 13A through the bracket mating with any existing pair of spaced holster openings on any of a variety of different holsters and at least one top bracket opening comprises a plurality of spaced horizontally aligned top bracket openings 11 and 11A through the bracket mating with any existing pair of spaced belt clip openings on any of a variety of different belt clips and the means for fastening planar elements 70 is inserted through each of the mating pairs of openings, thereby forming an adjustable gun holster concealment hanger bracket 10 to attach to any of a variety of different existing gun holsters each having an attached belt clip to convert each of the existing holsters into concealed holsters.

Figure 9:
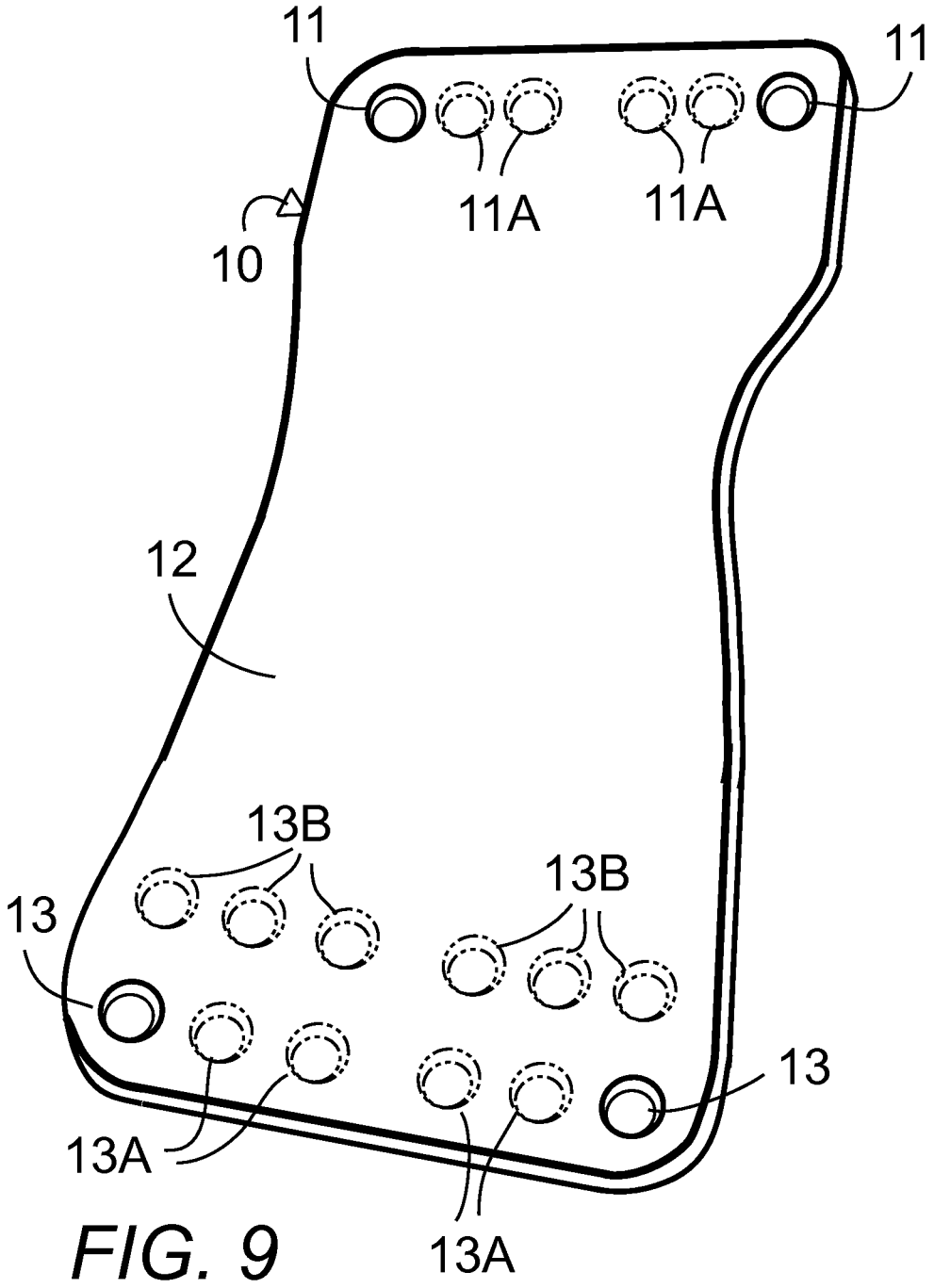
FIG. 9 is a perspective view of an alternate multiple horizontal opening adaptable and series of vertical openings adjustable embodiment of the gun holster concealment hanger bracket of the present invention having a plurality of spaced horizontally aligned bottom bracket openings through the bracket to mate with any existing pair of spaced holster openings on any of a variety of different holsters and a plurality of vertically stacked rows of bottom bracket openings through the bracket to mate with a pair of spaced holster openings so that any gun holster is adjustable in vertical position along the height of the bracket.

In FIG. 9, the at least one bottom bracket opening comprises a plurality of spaced horizontally aligned bottom bracket openings 13 and 13A through the bracket mating with any existing pair of spaced holster openings on any of a variety of different holsters and at least one top bracket opening comprises a plurality of spaced horizontally aligned top bracket openings 11 and 11A through the bracket mating with any existing pair of spaced belt clip openings on any of a variety of different belt clips and the means for fastening planar elements 70 is inserted through each of the mating pairs of openings, thereby forming an adjustable gun holster concealment hanger bracket 10 to attach to any of a variety of different existing gun holsters 30 each having a removed belt clip 20 attached to the bracket 10 to convert each of the existing holsters into concealed holsters, and the at least one bottom bracket opening further comprises a plurality of rows of spaced horizontally aligned bottom bracket openings 13B stacked on top of each other horizontal rows of plurality of mating spaced aligned pairs of bottom bracket openings through the bracket mating with a pair of spaced holster openings so that any of the variety of gun holsters is adjustable in vertical position along the height of the bracket 10 to insure full concealment of the gun and holster.

Figure 10:
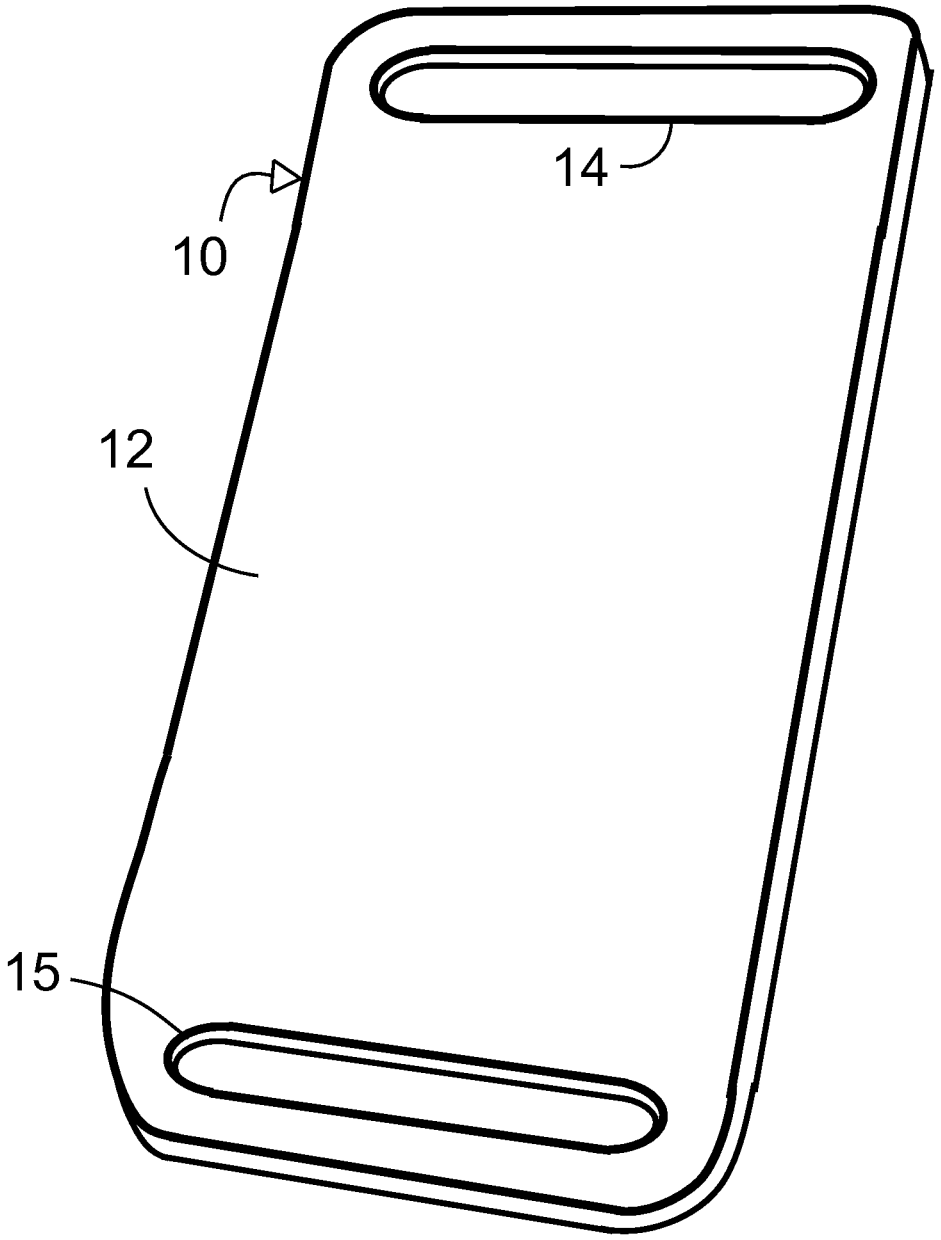
FIG. 10 is a perspective view of an alternate horizontal slot opening adaptable embodiment of the gun holster concealment hanger bracket of the present invention having top and bottom horizontal slot bracket openings through the bracket to mate with any existing pair of spaced holster openings on any of a variety of different holsters.

In FIG. 10, the at least one bottom bracket opening comprises a horizontal bottom bracket slot 15 through the bracket 10 mating adjustably with any existing pair of spaced holster openings 33 on any of a variety of holsters 30 and at least one top bracket opening comprises a horizontal top bracket slot 14 through the bracket mating adjustably with any existing pair of spaced belt clip openings 21 on any of a variety of belt clips 20, and the means for fastening planar elements 70 is inserted through the bracket slot 15 and any one of the mating pairs of holster openings 33 on any of a variety of gun holsters 30, thereby forming an adjustable gun holster concealment hanger bracket to attach to any of a variety of different existing gun holsters 30 each having an attached belt clip 20 attached by a means for fastening planar elements 70 to the top horizontal slot 14 of the bracket 10 to convert any of the existing holsters into concealed holsters.

Figure 11:
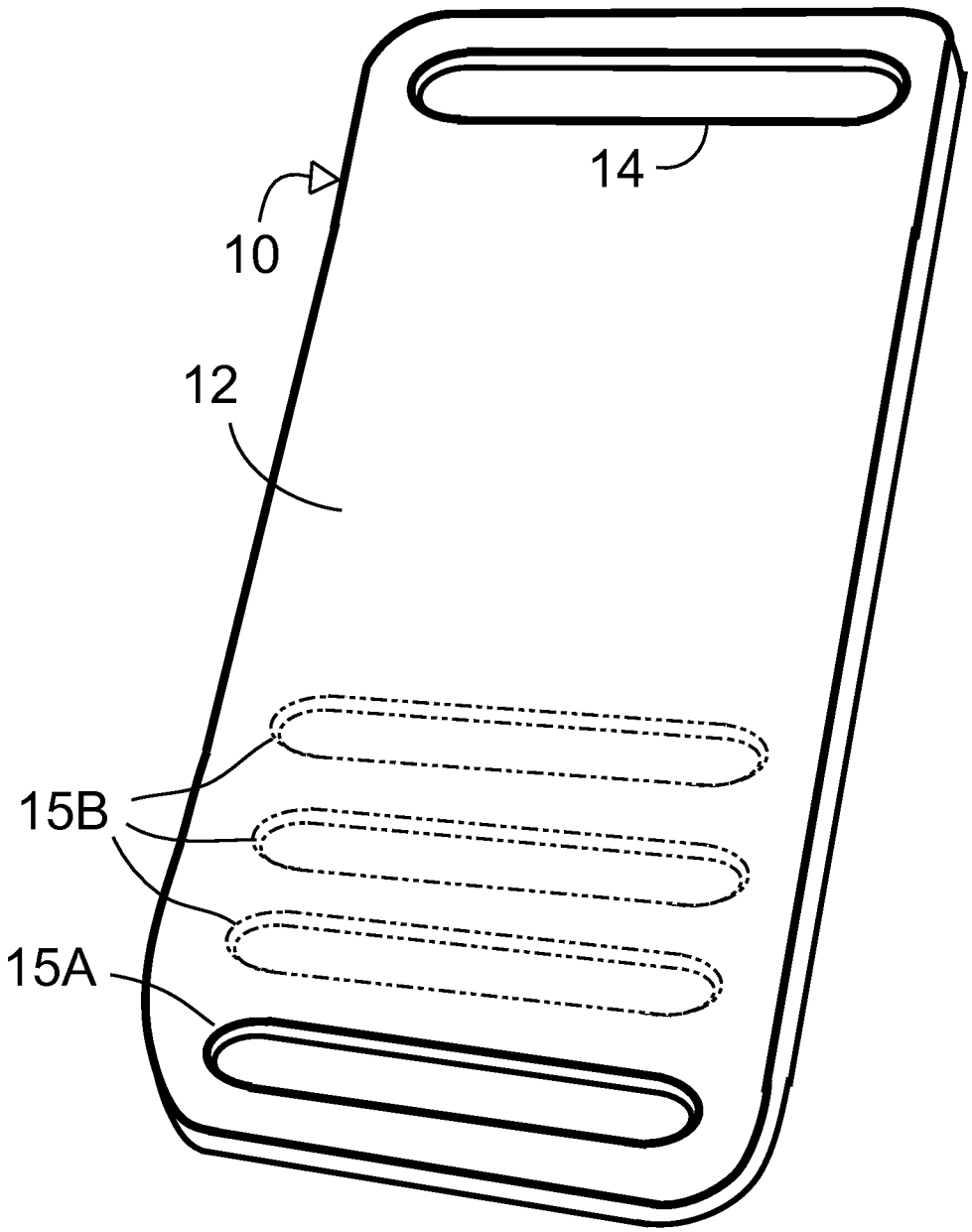
FIG. 11 is a perspective view of an alternate multiple bottom horizontal slot adaptable and adjustable embodiment of the gun holster concealment hanger bracket of the present invention having horizontal slot bracket openings through the bracket to mate with any existing pair of spaced holster openings on any of a variety of different holsters with a plurality of vertically stacked bottom horizontal slot bracket openings through the bracket so that any gun holster is adjustable in vertical position along the height of the bracket.

In FIG. 11, the at least one bottom bracket opening comprises a vertically spaced parallel array of horizontal bottom bracket slots 15A and 15B through the bracket mating adjustably with any existing pair of spaced holster openings 33 on any of a variety of holsters 30 and at least one top bracket opening comprises a horizontal top bracket slot 14 through the bracket mating adjustably with any existing pair of spaced belt clip openings 21 on any of a variety of belt clips and a means for fastening planar elements 70 is inserted through any one of the bracket slots 15A and 15B and one of the mating pairs of holster openings 33, thereby forming an adjustable gun holster concealment hanger bracket to attach to any of a variety of different existing gun holsters each having an attached belt clip to convert each of the existing holsters into concealed holsters, so that any one of the variety of gun holsters is adjustable in vertical position along the height of the bracket depending on which horizontal slot 15A and 15B is used on the bracket 10 to insure full concealment of the gun and holster.

The means for fastening planar elements 70 may comprise any fastener taken from the list of fasteners including rivets, threaded rivets, bolts and nuts, screws and nuts, clips, ties, and snaps.

The hanger bracket 10 is fabricated of a planar material sufficiently thin to fit comfortably between a pant waistband between the pants and the body of the user, sufficiently long to enable a gun and a gun holster hanging from the bracket to be completely concealed below a top of the pants, and sufficiently strong in tensile strength to support a gun holster and gun hanging from the hanger bracket.

The hanger bracket 10 may be fabricated of any planar material taken from the list of planar material including sheet metal, aluminum, natural fabric, synthetic fabric, leather, synthetic leather, plastic, rubber, and synthetic rubber.

In use, as shown in FIG. 2, a method for converting a gun holster 30 into a concealed gun holster, as shown in FIG. 5, using an attached gun holster concealment hanger bracket 10 comprises:

a first step of providing a gun holster concealment hanger bracket 10 comprising an elongated planar bracket 12 having means for attaching a bottom portion of a first face 12A of the hanger bracket 10, such as fasteners 70 through bottom bracket openings 13, to a gun holster 30 at an attachment location, such as mating holster openings 33, of a holster belt clip 20 with the holster belt clip 20 removed from the gun holster, and having means, such as fasteners 70 through top hanger bracket openings 11, for attaching the removed holster belt clip 20 to a top portion of a second face 12B of the hanger bracket 10;

a second step of removing the holster belt clip 20 from a belt clip attachment location, openings 33, on the gun holster 30 as indicated by arrow 2 in FIG. 2 with the belt clip 20 shown dashed as it normally is used directly on the holster 30 and shown solid in the removed position;

a third step of attaching the bottom portion of the first face 12A of the hanger bracket 10 to the gun holster 30 at the attachment location of the removed holster belt clip, by fasteners 70, which may have two interconnecting components 70A and 70B through bottom bracket openings 13 and holster openings 33, as indicated by arrows 3 in FIG. 2;

a fourth step of attaching the removed holster belt clip 20 to a top of a second face 12B of the hanger bracket 10 by fasteners 70, which may have two interconnecting components 70A and 70B, through top hanger openings 11 and mating belt clip openings 21, as indicated by arrows 4;

a fifth step of inserting the assembled hanger bracket 10, gun holster 30 and gun 40 inside the pants of the user so that the gun 40 and gun holster 30 hang down from the hanger bracket 10 inside the pants 60 or skirt or other garments worn on the lower body of the user in a concealed position, with all of the gun 40 and gun holster 30 concealed entirely from view below the top of the pants 61, as shown in FIG. 5;

a sixth step of extending the belt clip 20 from the top of the hanger bracket 10 out over the outside of a belt 50 of the user and clipping the belt clip 20 to the belt 50 of the user to support the hanger bracket 10 and the gun 40 and the gun holster 30 in the concealed position inside the pants 60 of the user, thereby providing a method of transforming a gun holster into a concealed gun holster using the gun holster concealment hanger bracket attached at the bottom of the hanger bracket to any gun holster having an attached holster belt clip with the holster belt clip removed from the holster and the holster belt clip attached to the top of the hanger bracket to allow the gun holster and gun to hang down inside the pants below a top of the pants.

The gun holster 30 and bracket 10 are inserted inside the pants 60 of the user with the normally outside surface of the gun holster facing in against the body of the user so that a user can easily reach inside the pants the user to draw the concealed gun 40 from the transformed concealed gun holster 30, as shown in FIG. 5.

It is understood that the preceding description is given merely by way of illustration and not in limitation of the invention and that various modifications may be made thereto without departing from the spirit of the invention as claimed.

What is claimed is:

1. A gun holster concealment hanger bracket device to attach to a gun holster to convert the gun holster into a concealed gun holster, the device comprising:

a hanger bracket comprising an elongated planar bracket having means for attaching a bottom portion of a first face of the hanger bracket to a gun holster at an attachment location of a holster belt clip with the holster belt clip removed from the gun holster, and having means for attaching the removed holster belt clip to a top portion of a second face of the hanger bracket; the hanger bracket, gun holster and gun inserted inside the pants of a user so that the gun and gun holster hang down from the hanger bracket inside the pants of the user in a concealed position, with all of the gun and gun holster concealed entirely from view below the top of the pants; and the belt clip extending from the top of the hanger bracket out over the outside of a belt of the user, the belt clip clipped to the belt of the user to support the hanger bracket and the gun and the gun holster in the concealed position inside the pants of the user, thereby forming a gun holster concealment hanger bracket to attach to any existing gun holster having an attached belt clip to convert the existing holster into a concealed holster.

2. The device of claim 1 wherein the means for attaching the bottom portion of the bracket to any existing holster comprises at least one bottom bracket opening through a bottom portion of the bracket, the at least one bottom bracket opening mating with at least one holster opening on the gun holster normally used in mounting the belt clip to the gun holster, and with the belt clip removed, the bottom of the bracket secured to the gun holster by means for fastening planar elements inserted through the at least one bottom bracket opening and the at least one holster opening; and the means for attaching the top portion of the bracket to the removed belt clip comprises at least one top bracket opening through the bracket mating with at least one existing belt clip opening for mounting the belt clip to the top of the bracket, the top of the bracket secured to the removed belt clip by means for fastening planar elements inserted through the at least one top bracket opening and the at least one belt clip opening.

3. The device of claim 2 wherein the at least one bottom bracket opening comprises a pair of spaced bottom bracket openings through the bracket mating with an existing pair of spaced holster openings and at least one top bracket opening comprises a pair of spaced top bracket openings through the bracket mating with an existing pair of spaced belt clip openings and the means for fastening planar elements is inserted through each of the mating pairs of openings.

4. The device of claim 3 wherein the at least one bottom bracket opening comprises a plurality of spaced horizontally aligned bottom bracket openings through the bracket mating with any existing pair of spaced holster openings on any of a variety of different holsters and at least one top bracket opening comprises a plurality of spaced horizontally aligned top bracket openings through the bracket mating with any existing pair of spaced belt clip openings on any of a variety of different belt clips and the means for fastening planar elements is inserted through each of the mating pairs of openings, thereby forming an adjustable gun holster concealment hanger bracket to attach to any of a variety of different existing gun holsters each having an attached belt clip to convert each of the existing holsters into concealed holsters.

5. The device of claim 3 wherein the at least one bottom bracket opening comprises a plurality of spaced vertically aligned pairs of bottom bracket openings through the bracket mating with a pair of spaced holster openings so that the gun holster is adjustable in vertical position along the height of the bracket to insure full concealment of the gun and holster.

6. The device of claim 3 wherein the at least one bottom bracket opening comprises a pair of spaced vertically aligned slots through the bracket mating with a pair of spaced holster openings so that the gun holster is adjustable in vertical position along the height of the bracket to insure full concealment of the gun and holster.

7. The device of claim 2 wherein the at least one bottom bracket opening comprises a horizontal bottom bracket slot through the bracket mating adjustably with any existing pair of spaced holster openings on any of a variety of holsters and at least one top bracket opening comprises a horizontal top bracket slot through the bracket mating adjustably with any existing pair of spaced belt clip openings on any of a variety of belt clips and the means for fastening planar elements is inserted through the bracket slot and any one of the mating pairs of holster openings on any of a variety of gun holsters, thereby forming an adjustable gun holster concealment hanger bracket to attach to any of a variety of different existing gun holsters each having an attached belt clip to convert any of the existing holsters into concealed holsters.

8. The device of claim 2 wherein the at least one bottom bracket opening comprises a vertically spaced parallel array of horizontal bottom bracket slots through the bracket mating adjustably with any existing pair of spaced holster openings on any of a variety of holsters and at least one top bracket opening comprises a horizontal top bracket slot through the bracket mating adjustably with any existing pair of spaced belt clip openings on any of a variety of belt clips and the means for fastening planar elements is inserted through any one of the bracket slots and one of the mating pairs of holster openings, thereby forming an adjustable gun holster concealment hanger bracket to attach to any of a variety of different existing gun holsters each having an attached belt clip to convert each of the existing holsters into concealed holsters, so that any one of the variety of gun holsters is adjustable in vertical position along the height of the bracket to insure full concealment of the gun and holster.

9. The device of claim 2 wherein the means for fastening planar elements comprises any fastener taken from the list of fasteners including rivets, threaded rivets, bolts and nuts, screws and nuts, clips, ties, and snaps.

10. The device of claim 1 wherein the hanger bracket is fabricated of a planar material sufficiently thin to fit comfortably between a pant waistband between the pants and the body of the user, sufficiently long to enable a gun and a gun holster hanging from the bracket to be completely concealed below a top of the pants, and sufficiently strong in tensile strength to support a gun holster and gun hanging from the hanger bracket.

11. The device of claim 6 wherein the bracket is fabricated of any planar material taken from the list of planar material including sheet metal, aluminum, natural fabric, synthetic fabric, leather, synthetic leather, plastic, rubber, and synthetic rubber.

12. A method for converting a gun holster into a concealed gun holster using an attached gun holster concealment hanger bracket, the method comprising:

a first step of providing a gun holster concealment hanger bracket comprising an elongated planar bracket having means for attaching a bottom portion of a first face of the hanger bracket to a gun holster at an attachment location of a holster belt clip with the holster belt clip removed from the gun holster, and having means for attaching the removed holster belt clip to a top portion of a second face of the hanger bracket;

a second step of removing the holster belt clip from a belt clip attachment location on the gun holster;

a third step of attaching the bottom portion of the first face of the hanger bracket to the gun holster at the attachment location of the removed holster belt clip;

a fourth step of attaching the removed holster belt clip to a top of a second face of the hanger bracket;

a fifth step of inserting the assembled hanger bracket, gun holster and gun inside the pants of the user so that the gun and gun holster hang down from the hanger bracket inside the pants of the user in a concealed position, with all of the gun and gun holster concealed entirely from view below the top of the pants;

a sixth step of extending the belt clip from the top of the hanger bracket out over the outside of a belt of the user and clipping the belt clip to the belt of the user to support the hanger bracket and the gun and the gun holster in the concealed position inside the pants of the user, thereby providing a method of transforming a gun holster into a concealed gun holster using the gun holster concealment hanger bracket attached at the bottom of the hanger bracket to any gun holster having an attached holster belt clip with the holster belt clip removed from the holster and the holster belt clip attached to the top of the hanger bracket to allow the gun holster and gun to hang down inside the pants below a top of the pants.

* * * * *